United States Patent [19]

Wood

[11] 4,208,890

[45] Jun. 24, 1980

[54] CONTROL CIRCUITS IN OR FOR WASHING, DRYING AND THE LIKE MACHINES OR OTHER APPARATUS

[75] Inventor: Raymond F. Wood, Stafford, England

[73] Assignee: Servis Domestic Appliances Limited, Wednesbury, England

[21] Appl. No.: 836,720

[22] Filed: Sep. 26, 1977

[51] Int. Cl.[2] ..... D06F 33/02

[52] U.S. Cl. ..... 68/12 R; 361/93

[58] Field of Search ..... 68/12 R; 361/93, 100, 361/101, 102

[56] References Cited

U.S. PATENT DOCUMENTS

| | | | |
|---|---|---|---|
| 3,922,889 | 12/1975 | Karklys | 68/12 R |
| 3,986,372 | 10/1976 | Karklys | 68/12 R |

FOREIGN PATENT DOCUMENTS

| | | |
|---|---|---|
| 1197528 | 7/1970 | United Kingdom . |
| 1237342 | 6/1971 | United Kingdom . |
| 1299586 | 12/1972 | United Kingdom . |
| 1328664 | 8/1973 | United Kingdom . |

*Primary Examiner*—Philip R. Coe

*Attorney, Agent, or Firm*—Merriam, Marshall & Bicknell

[57] ABSTRACT

A control circuit for controlling current supply to machines, such as a washing machine, the control circuit controlling the state of a first switch adapted to switch current to control means associated with the machine, functional means being monitored, such monitoring being operative to, should a fault occur, cause the first switch to open, and a back-up circuit, responsive to said monitors, including switching means operative to disconnect the current from the functional means if a fault occurs irrespective of the state of the first switch.

8 Claims, 7 Drawing Figures

DL MAINS
D3
D4
R17
R18
15a
0V
R19
R20
R21
TR3
C3
R22
15b
R26
16
LOGIC CIRCUIT
(RESET) INPUT
DL OP
10
10j
10a
R27
TR4
D5
R28
15c
R29
R30
TR5
R31
D9
R32
TR6
R33
14a
-5
13a
Q1a
DOOR LOCK
S1a
12a
B1
15a1
230V
h1
h2
h3
IC1h
R23
R24
R25a
R25b
C4
29
30
-16V

CONTROL CIRCUITS IN OR FOR WASHING, DRYING AND THE LIKE MACHINES OR OTHER APPARATUS

BACKGROUND OF THE INVENTION

Field of the Invention

This invention relates to control circuits for controlling the supply of current from a source to an apparatus including a plurality of functional devices energised for operation by such current.

To provide safety in operation of such apparatus it is important to ensure that the current be interrupted at least to those of the functional devices whereof continued operation, whether faulty or not, could produce a hazardous condition for the user or persons in proximity to the apparatus.

BRIEF SUMMARY OF THE INVENTION

The principal object of the present invention is to provide a control circuit which meets this requirement.

According to the first aspect of the present invention there is provided a control circuit for controlling the supply of current from a source to an apparatus which includes a plurality of functional means, such circuit comprising:

a. a first switch means controlling the supply of current to at least some of said functional means, b. a main control means for furnishing signals to set the first switch means in a closed or open position in accordance with programme demand requirements applicable to the apparatus, c. at least one monitoring means each associated with a respective one of the functional means for generating a fault signal in response to occurrence of a fault condition, d. means connecting the monitoring means with the main control means to cause the latter to set the first switch means in an open condition in response to generation of said fault signal, e. a second switch means for controlling current to at least one of the functional means, f. a back-up circuit means connecting the second switch means and the monitoring means, the second switch means being responsive to generation of said fault signal to cut-off current to the functional means irrespective of response of the main control means to said fault signal.

Preferably, the first switch means comprises main switch contacts movable relatively between open and closed positions, and one of the functional means comprises electrically energised operating means for the main switch contacts, and which is controlled by the second switch means, the latter being responsive to either the generation of an output (reset) signal from the main control means, or to operation of the back-up circuit means in response to generation of a fault signal.

Preferably the back-up circuit means includes latch means for maintaining the second switch means in its open condition when it has been opened through generation of a fault signal and operation of the back-up circuit means. The latch means may continue to establish the first switch means in its open condition responded properly to the fault signal by generating an output (reset) signal itself to opening of the first switch means.

Thus, for current to continue to be supplied to one of said functional means after the associated monitoring means has responded to a fault condition, there would have to be a fault both in the main control means and in the back-up circuit means and associated second switch means.

The main control means may include an electronic programming means for determining the sequence, and/or duration, and/or mode of operation of said functional means and is settable to generate said output (reset) signal in response to generation of a fault signal by said monitoring means. The second switch means may comprise a semi-conductor switch which may be connected to control the supply of current to the electrically energised operating means for the main switch contacts and is itself responsive firstly to said output (reset) signal from the programming means and secondly through the back-up circuit means to said fault signal in a manner such that either of these two last said signals is operative to cause the semi-conductor switch to interrupt current supply to the electrically energised operating means for the main switch contacts.

The latch means previously mentioned may comprise a comparator means having first and second input terminals, the former being connected to a sub-circuit providing an input changing in value in accordance with the incidence or not of a fault signal, and the latter being connected to a sub-circuit providing an input changing in value in accordance with a combination of the output (reset) signal and opening and closing of the first switch means, the output of the comparator means having one or the other of values which respectively maintain the second switch means closed or cause it to open, the latter value being maintained permanent upon incidence of a fault signal if an output (reset) signal is not generated by the main control means.

Whilst it would be within the scope of the invention for the monitor means to take any of a number of forms, a preferred form of monitoring means comprises one or more monitoring circuits each of which includes a comparator means, such as an integrated circuit element connected in a comparator mode, and having at least two input terminals and an output terminal, one of the two input terminals being connected to a sub-circuit providing an input of reference level and the other terminal being connected to a sub-circuit containing a sensing means and providing an input which varies according to the parameter being sensed in the associated functional means, the output terminal providing an output the value of which changes from a normal value to a fault value according to whether the functional means associated with such monitoring circuit is operating normally or has become abnormal.

It will be understood that abnormality may in each case result from the development of an electrical fault such as an open circuit, short circuit, change of resistance or impedence value in components of the functional means such as electrical heaters, motor windings, and so forth. Alternatively, or in addition, the condition of abnormality may result when a particular functional means is operating otherwise than in accordance with the demand made to it from the programming means.

The invention may be applied generally, but one of its primary applications is to a control circuit for controlling machines (hereinafter referred to as being of the kind specified) for subjecting articles to treatment involving a liquid, each such machine comprising a body, including a chamber in which the articles can be placed for treatment, a plurality of functional means for performing respective functions during a treatment programme and including means for effecting transfer of the liquid to or from the chamber so that it is brought into contact with, or removed from, the articles, and means for subjecting at least either the liquid or the articles to motion whilst both are in the chamber, said functional means being each electrically controlled or operated, said control circuit comprising a main control circuit means including electronic programming means for bringing the functional means into and out of operation in accordance with at least one, and preferably in accordance with a selected one, of a plurality of programmes to effect the particular treatment required.

In this respect the invention has been developed primarily in relation to a machine of the kind specified intended for washing clothes or other textile articles, and hereinafter referred to as a clothes washing machine of the kind specified. In this case the means for effecting transfer of liquid to and from the chamber includes valve means operative in supply ducts for the liquid, and includes pump means for draining the liquid from the chamber, whilst the means for subjecting either the liquid or the articles to motion may comprise either a drum defining the chamber and which is mounted for rotation by means of a drive motor, or may in some cases comprise paddle or impeller means for setting up flow patterns in the liquid whilst in the chamber. The washing machine may incorporate means for subjecting the clothes to tumble drying or not as may be desired.

It will be understood, however, that the invention may be applied to other forms of machine of the kind specified and in particular, but not exclusively, dish washing machines.

In the case of dish washing machines, the means for effecting transfer of liquid to and from the chamber may again be in the form of valve means operative in one or more inlet ducts for the liquid and may further comprise pump means for draining the liquid from the chamber, whilst the means for subjecting at least the liquid or the articles to motion may comprise a pump means operating in conjunction with a liquid delivery nozzle movable or otherwise for directing the liquid onto the articles to be washed and may further comprise means for rotating a drum, container or holder in which such articles are supported.

In any of these forms of machine of the kind specified the programming means, as mentioned, determines the sequence and/or duration, and/or mode of performance of different operations which collectively comprise the treatment and which are performed by the functional means already referred to.

It is of importance, irrespective of whether the programming means provides facilities for operating the machine in accordance with a single programme or with any one of a plurality of different programmes, that any malfunctioning of the functional means shall be detected and brought to the user's attention as early as possible after such malfunctioning has started to occur. This is partly because continuance of the malfunctioning may damage the machine and/or the articles undergoing treatment, and partly because, even if the malfunctioning is of a character such that it is not likely to cause or promote such damage, it is desirable that its occurence should be detected so that the article will not be assumed to have undergone a specified treatment for which the machine and programming means was designed without such treatment actually having been carried out.

From a second aspect of the invention resides in the provision in a machine of the kind specified of a control circuit including a first switch means for controlling the supply of current to each of the functional means and settable in either an "open" state or a "closed" state respectively to establish or cut off current supply to the functional means, and two separate means for causing the first switch means to be set in its "open" state in response to operation of monitoring means monitoring proper operation of one or more of the functional devices, one of which separate means comprises the programming means and the other of which comprises a back-up circuit means operating in this respect independently of the programming means.

The statistical risk that a fault or malfunctioning of both the programming means and the back-up circuit means will occur simultaneously is very substantially less than the risk of such an occurrence in either one of these means taken singly and this contributes materially to reduction of the risk that the machine will continue without detection to operate in an unsafe manner or otherwise than in accordance with the intended functioning of the functional means as determined by the programming means.

Any of the optional features hereinbefore described as applicable to the control circuit in accordance with the first aspect of the invention may be applied to the machine and control circuit thereof in accordance with the second aspect of the invention.

BRIEF DESCRIPTION OF THE DRAWINGS

The invention will now be described, by way of example, with reference to the accompanying drawings wherein:-

DESCRIPTION OF THE PREFERRED EMBODIMENTS

Figure 1:
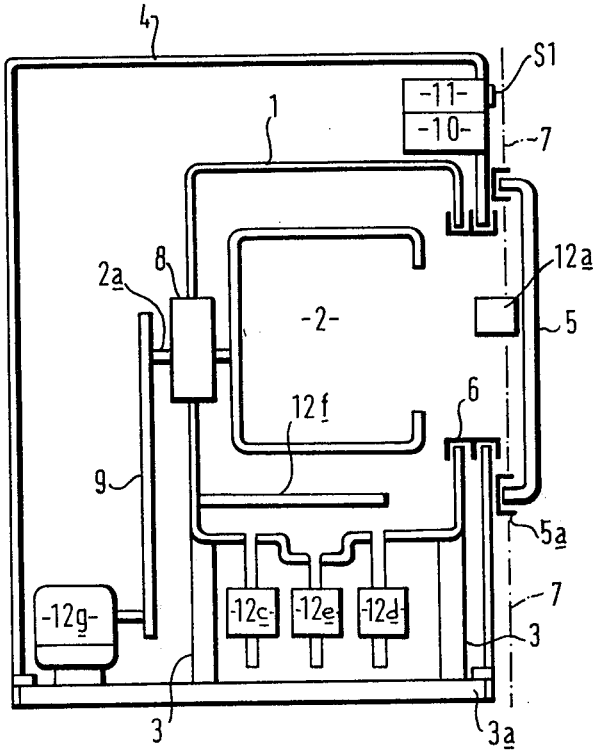
FIG. 1 is a diagrammatic view in side elevation and in vertical cross-section of one embodiment of washing machine in accordance with the invention.

The washing machine illustrated in FIG. 1 comprises a body which includes a stationary washing chamber 1 which may be of generally cylindrical form containing a washing drum 2 rotatable about a horizontal axis, the washing chamber 1 being supported in any suitable manner, as, for example, by struts 3 from a base 3*a*.

A casing 4 encloses the washing chamber and drive means for the drum 2 which comprises a motor 12*g* which drives the drum spindle 2*a* through the intermediary of a belt and pulley drive 9. The spindle 2*a* and drum is supported by a suitable bearing 8 carried by the washing chamber.

The washing chamber has a plurality of inlets, for example a hot water inlet controlled by a solenoid valve 12*c*, a cold water inlet controlled by a solenoid valve 12*d* and a drain outlet, preferably communicating with a well or sump in the washing chamber and controlled by an electrically driven pump 12*e*. It will be understood that other electrically energised functional units, such as a comfort valve, are omitted from FIG. 1 merely for simplicity. The comfort valve controlls the flow of inlet water during a final rinse through a reservoir containing a rinsing agent. A door lock operated by an electrically energised device preferably of the thermo-valve type may be provided as illustrated in FIG. 2 hereinafter referred to.

The sequence in which the functional units are brought into operation, and the length of time, and the number of times for which these are operated, during a complete washing cycle is determined by a logic circuit 10 which is mounted in the casing. The logic circuit 10 is settable in accordance with a number of different programmes by the programme selector 11 with which is associated a number of manually operable switches such as S1 (FIG. 1) for selecting the programme desired.

The washing chamber 1 is sealed with respect to the casing by a flexible gasket or sealing ring 6 and the entrance to the washing chamber 1 and drum 2 is controlled by a door 5 which is hingedly connected to the casing 4 about a vertical axis 7 and is movable upon release of the door lock between the closed position shown and an open position. Associated with the door is a sealing ring or gasket 5*a* operative between the door and the casing.

Figure 2:
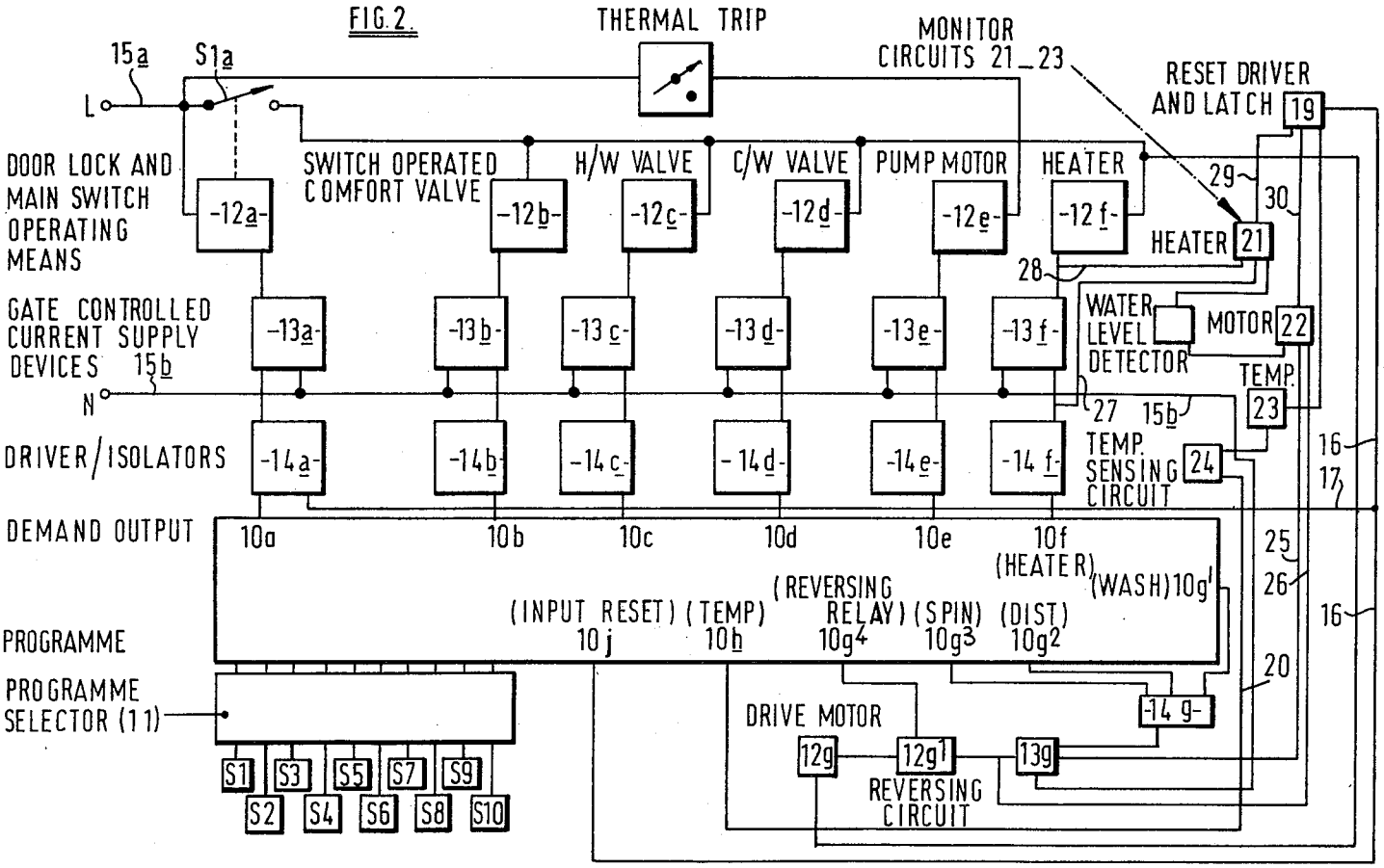
FIG. 2 is a schematic circuit diagram of the control circuit of such a washing machine including the current controlling means and monitoring circuits of the present invention as hereinbefore mentioned.

Referring now to FIG. 2, the electrically energised functional units are identified at 12*a* to 12*g* (certain of these having already been mentioned) and comprise respectively an electrically energised operating means 12*a* for operating or controlling operation of the door lock and switch contacts S1*a*, a solenoid operated comfort valve 12*b*, a solenoid operated hot water admission valve 12*c*, a solenoid operated cold water admission valve 12*d*, a pump motor 12*e* for driving a pump to drain the washing chamber, a heater 12*f* for heating the water washing chamber, and a drive motor 12*g* for rotating the drum 2.

The supply of current to these units, from a 240 volt alternating current mains supply connected to line and neutral terminals L and N, is controlled respectively by gate controlled semi-conductor devices 13*b* to 13*g* in accordance with output signals (D.C. voltage levels) developed at the outlets of a logic circuit 10, these signals being fed to the gate electrodes of the devices 13*b* to 13*g* respectively through the intermediary of output circuit means (driver/isolator circuits) 14*b* to 14*g*. The last mentioned provides for operation of the drive motor 12*g* in three different modes, periodically reversing (for wash), unidirectional low speed (for distribution of washing load), and unidirectional high speed (spin for centrifugal water extraction).

The particular outlets of the logic circuit 10 at which outlet signals are developed, and the sequence of such outlet signals, is determined by a programme selector 11 with which is associated a plurality of switches S1 to S10 pertaining to different programmes respectively, these switches being manually operable. The circuits 10 and 11 form the main control circuit or programming means previously referred to.

In the conductor 15*a*, which is common to the functional units, relatively movable switch contacts S1*a* (the first switch means hereinbefore referred to) of a main switch, which is operated by the operating means 12*a* including a delay means for holding the switch when closed in this position for a predetermined time. The operating means may comprise thermo-motive device such as an electrically heated bimetal strip, may comprise a solenoid with means for delaying drop off, are connected. These operating means 12*a* for the switch contacts includes biasing means, either spring, (e.g. the bimetal strip when not heated), gravitational, or combinations of the two for maintaining the switch contacts normally open. As mentioned the operating means 12*a* also serves, when energised, to operate or control operation of a door lock. The contacts S1*a* can be caused to open by opening a manually operable means switch connected between the mains supply terminals and the terminals L and N. The door lock would then be opened only after a delay determined by the delay means of the operating means 12*a*.

The operating means 12*a* contains an energising element B1 (FIG. 6) and the current supply to this, for operating S1*a* and operating or controlling the door lock, is controlled by a further switch (the second switch means hereinbefore referred to) in the form of a solid state semi-conductor switch, namely triac Q1*a* contained in driver circuit 13*a*. This triac is rendered conducting by an output (set) signal from terminal 10*a* of the logic circuit 10 upon selection of any programme by the programme selector 11, and the logic circuit 10 will continue to maintain B1 energised until either the programme is terminated in the normal way in the logic circuit 10, or a fault (reset) signal is applied along conductor 16 to the input (reset) terminal 10*j* of the logic circuit 10 to change the logic circuit to the reset condition. This causes it to generate an output (reset) signal to be present at terminal 10*a* rendering triac Q1*a* non-conducting. Further, a fault (reset) signal can also be delivered along the conductors 16 and 17 from a reset driver and latch circuit 19 of FIG. 5 to driver isolator circuit 14*a* to switch off triac Q1*a* (in 13*a*) irrespective of whether this switching off is or is not accomplished by logic circuit 10.

Thus, the supply of current to each of the functional units 12*b* to 12*g* through conductors 15*a*, 15*b* is controlled firstly by the first main switch means S1*a* (common to all of them), secondly by the second switch means triac Q1*a* (also common to all of them), and thirdly by the respective gate controlled current supply devices 13*b* to 13*g* (individual to units 12*b* to 12*g* respectively) and which may also comprise triacs.

Certain of the functional units have monitor circuits associated respectively with them, namely the heater 12*f* (associated monitor circuit 21) and the drive motor 12*g* (associated monitor circuit 22) to develop fault (reset) signals in the event of abnormal operating conditions occurring. Further, a temperature sensing circuit 24 is provided, the normal operation of which is to sense the temperature of the water in the drum, and to provide a temperature input signal along conductor 20, at terminal 10*h*, to the logic circuit. If such temperature signal corresponds to an unacceptably high water temperature then the logic circuit generates an output (reset) signal at terminal 10*a* effective to open the second switch means Q1*a*. A monitor 23 is associated with the sensor of the temperature sensing circuit to simulate a high temperature signal in the event of the sensor becoming faulty, e.g. a thermistor which goes open circuit. The temperature sensing circuit 24 is thus to be considered as one of the functional units to be monitored. It will be understood that other functional units may, if desired, have associated monitor circuits which, when detecting an abnormal condition, generate an input (reset) signal fed to the logic circuit 10.

Figure 3:
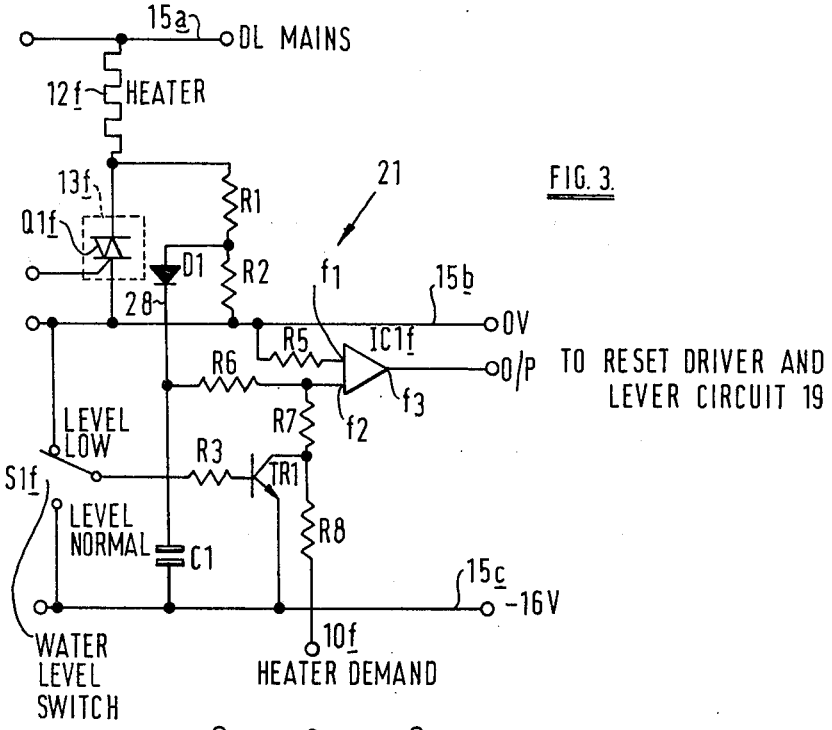
FIG. 3 is a circuit diagram of one of the monitoring circuits associated with the heater.
Figure 6:
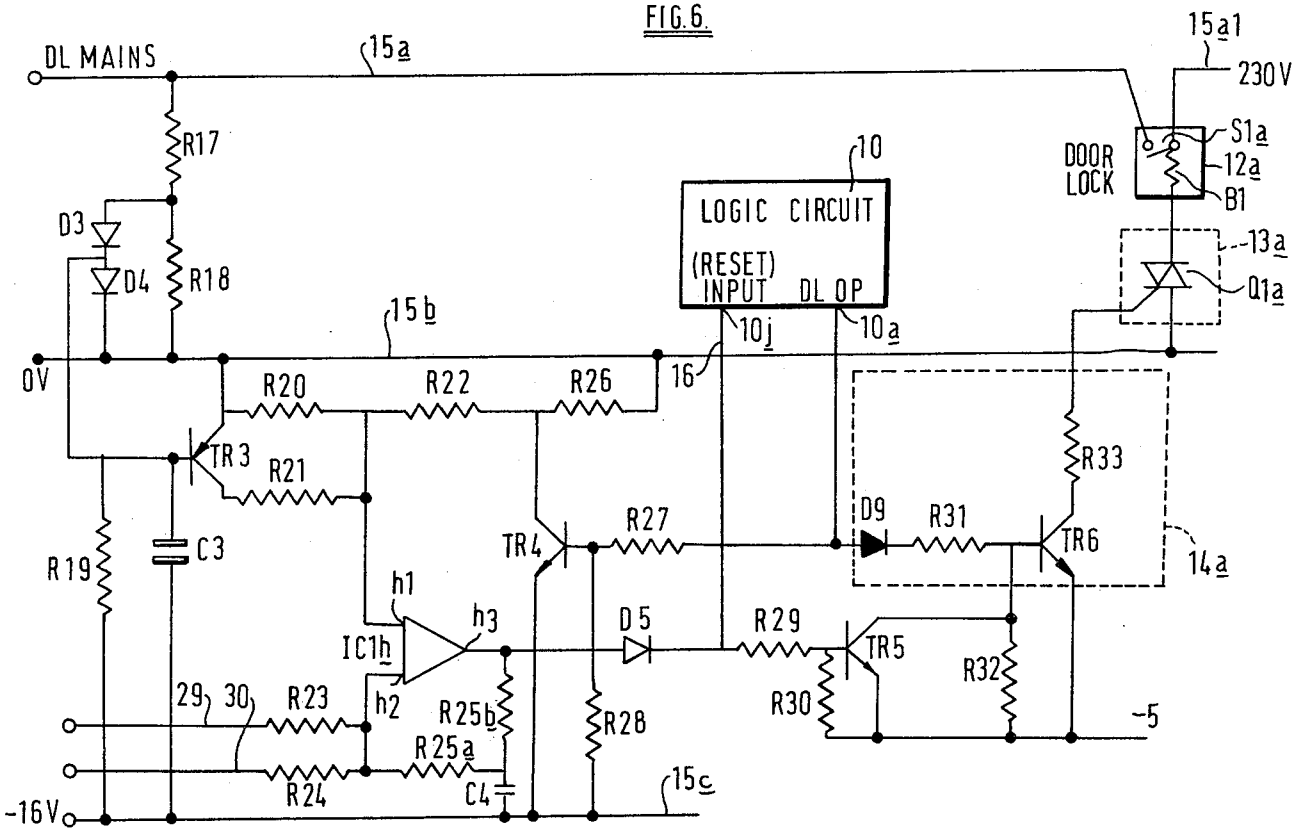
FIG. 6 is a circuit diagram of the reset drive and latch circuit through which output signals from the circuits of FIGS. 3 and 4 or 5 are fed back to the logic circuit and directly to the second switch means to cause the first switch means to be opened and held open.

Referring now to FIG. 3, the monitor circuit 21 shown therein monitors proper operation of the heater 12*f*. It comprises an integrated circuit unit IC1*f* operating as a comparator and having two input terminals f1, f2 and an output terminal f3. The output terminal f3 provides the output from the circuit and is connected by way of conductor 29 (FIG. 2) to the reset drive and latch circuit 19 (FIG. 6). Terminal f3 can have either a high voltage level or a low voltage level, the former resulting in delivery, from circuit 19, of a fault (reset) signal along conductors 16 and 17, and the latter representing the normal operative condition allowing the selected programme to continue.

Terminal 10*f* is connected to the logic circuit 10 and receives a "high" signal corresponding to heater demand as part of the programme and a "low" signal when no heater function is demanded.

The monitor circuit includes a level detector switch S1*f* forming a sensing means. This switch is a changeover switch and is moved into the position shown, i.e. movable contact in the up position, when the water level is low i.e. below the predetermined low level, and changes over to the movable contact down position when the water level is normal i.e. at or above the predetermined low level. This monitor circuit operates in the following manner.

The output at terminal f3 of the comparator is dependent upon the relative magnitudes of the currents through R5 on the one hand (positive input). Output at f3 is low, i.e. representing a normal operative condition, when the current at terminal f2 predominates. Output at f3 goes high, representing an abnormal condition, when current at f1 predominates.

When no heater function is demanded, by reason of the settings of circuits 10 and 11, through R7, R8, current at f2 is determined by the current through R6. If triac Q1*f* is turned off, resistor R1 at its upper end is virtually at 240 volts AC derived from conductor 15*a*. The network R1, R2, D1, C1, produces a direct voltage at the junction of D1 with C1 of approximately +10 volts. In this state the current representing negative input to f2 exceeds the current representing positive input to f1 and output at f3 is low (normal).

When triac Q1*f* is turned on, the voltage at the junction of D1, C1, falls to approximately −1 volts, current representing positive input to f1 predominates and the comparator output terminal f3 goes high generating a fault (reset) signal.

If, however, under the last described conditions, a heater demand function were present at terminal 10*f*, by reason of the settings of circuits 10 and 11, the input to f2 through R6 would be over-ridden and would exceed that occurring at f1 maintaining f3 in the low (normal) condition.

In the case where a heater demand function exists, but the movable contact of the low level switch Sf1 is in its up position (as shown) corresponding to low water level, the base of transistor TR1 would be positively biased with respect to its emitter, TR1 would be turned on, and cancel the effect of the heater demand, thereby restoring f3 to the high fault signal (reset) level.

The following table summarises these various operative conditions.

| Truth Table | Heater Triac Q1f | Heater Demand | L.L. Switch S1f | Comparator Output at f3 |
|---|---|---|---|---|
| No heater, no demand | OFF | OFF | X | LOW (normal) |
| Heater on + no demand | ON | OFF | X | HIGH (fault reset) |
| Heater on + heater demand | ON | ON | O/C | LOW (normal) |
| Heater on + low water level | ON | X | S/C | HIGH (fault reset) |

X = Immaterial.

Figure 4:
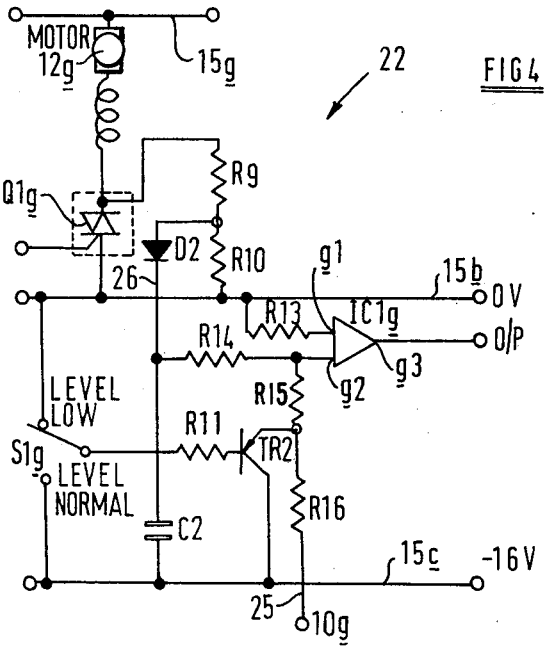
FIG. 4 is a circuit diagram of a further monitoring circuit associated with the drive motor for the washing machine drum.

Referring now to FIG. 4, this shows in detail one form of monitor circuit 22 for monitoring proper operation of the drive motor relative to spin demand and water level in the drum. The operation of the circuit is in principle similar to that of FIG. 3. The low level water switch previously mentioned has additional contacts S1*g* in this monitor circuit. The spin demand signal calling for motor drive is furnished at terminal 10*g* from the logic circuit 10 and fed to circuit 22 from the output side of driver/isolator 14*g*, the device 13*g*, and along conductor 25.

Output at the terminal g3 of comparator circuit IC1*g* goes high for abnormal conditions generating a fault (reset) signal, and is low for normal operative conditions. The state of terminal g3 is dependent on the relative values of currents through R13 to terminal g1 representing positive input on the one hand and through R14, R15, R16 to terminal g2 representing negative input on the other hand.

If triac Q1*g* is turned off, the junction of diode D2 and capacitor C2 is, as before, approximately 10 volts and in this state the input current to g2 exceeds input current to g1 and output at g3 is low.

When the conduction angle of Q1*g* is greater than 100° (corresponding to high speed spin) the D2, C2 junction falls below zero volts and comparator output at g3 goes high generating a fault (reset) signal. If, however, spin demand terminal 10*g* is high under these conditions then current through R15 and R16 overrides (or augments) current at R14, thereby inhibiting the fault (reset) signal.

If however, the low level switch S1*g* is in its movable contact down position indicating the presence of water above the predetermined low level (and which would present an excessive load on the motor endeavouring to execute a spin), transistor TR2 conducts cancelling the effect of the spin demand terminal 10*g* and causing g3 to go high and produce a fault (reset) signal.

The following table summarises these operational conditions.

| Truth Table | Motor Triac conduction angle | Spin Demand | L.L. Switch | Comparator output |
|---|---|---|---|---|
| Motor spin plus no demand | Less than 100° | X | X | LOW |
| Motor spin plus no demand | Greater than 100° | OFF | X | HIGH fault (reset) |
| Motor spin | Greater than | ON | Up | LOW |

-continued

| Truth Table | Motor Triac conduction angle | Spin Demand | L.L. Switch | Comparator output |
|---|---|---|---|---|
| plus demand | 100° | | | |
| Motor spin plus water high level | Greater than 100° | X | Down | HIGH fault (reset) |

X = Immaterial

Figure 5:
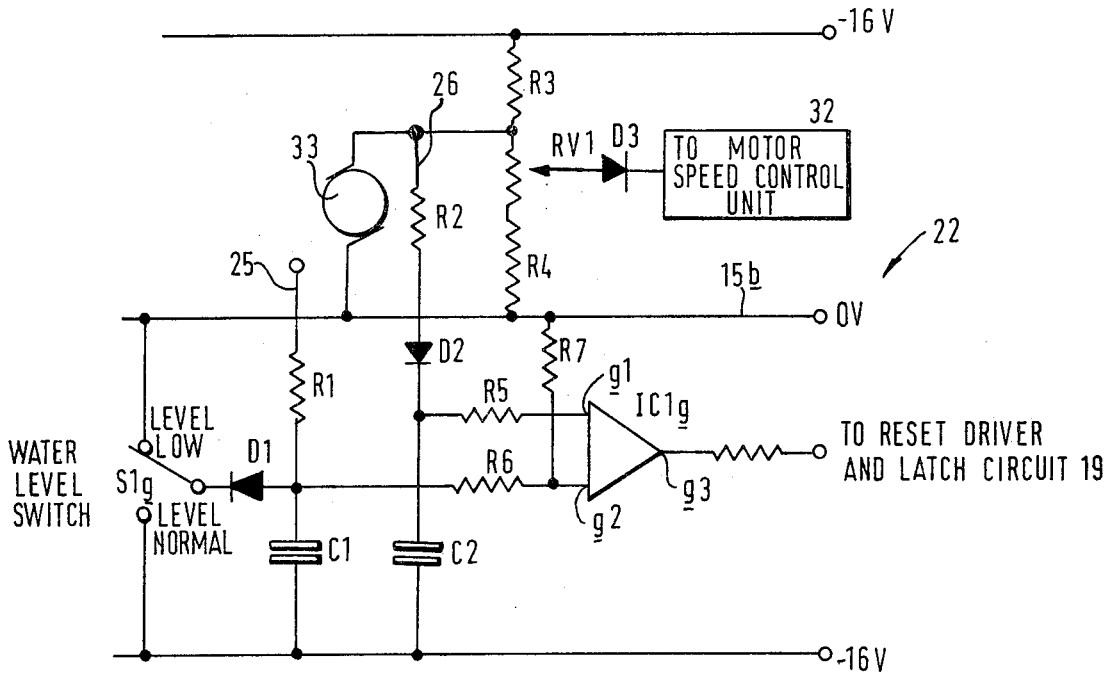
FIG. 5 is a circuit diagram of an alternative form of monitoring circuit to that shown in FIG. 4.

FIG. 5 shows an alternative form of circuit for use as monitor circuit 22. In this components corresponding to those of FIG. 4 bear corresponding references. The input to terminal g1 is fed through R2, D2 and R5 and is derived from a tacho-generator 33 driven from the motor 12*g* and providing an alternating voltage of between 0 and 10 (positive) depending upon motor speed; 10 volts output corresponds to motor operating at high (spin) speed. The terminal g2 is tied to the zero volt line 15*b* through R7. The manner of operation is as follows.

A fault (reset) signal is generated at g3 (high) if the input to g1 from the tacho-generator via R2, D2 and R5 exceeds the reference input to g2 via R7. C2 smooths the ripple from the half wave tacho-generator signal. R2 is chosen so that the fault condition occurs when the drum speed exceeds a predetermined value selected in the range approximately 150–200 r.p.m. If a spin demand is present on conductor 25 the input at g2 via R1 and R6 overrides any input at g1 from the tacho-generator. If, however, there is water above the low level in the drum, the level switch changes over to the movable contact down position and cancels the spin demand via diode D1, generating a fault (reset) signal at g3.

The R1, C1 time constant allows the spin demand to rise fast enough to avoid a spurious fault detection on selecting a spin due to the input at g2 remaining below that at g1 during motor acceleration.

When spin demand is intentionally discontinued the R6, C1, time constant holds the spin demand high long enough to allow the motor to run down below the trip speed level.

The slider of RV1 supplies an A.C. feed-back signal rectified through D3, dependent upon tacho-generator output voltage, to a motor speed control unit 32. This unit includes means for generating references (demand) voltages selected to provide wash, distribute, and spin speeds for the motor. The feed-back signal and the selected reference voltage are fed to an amplifier in the unit which provides an output to the motor dependent upon the difference so as to operate the motor at a stable selected speed. If the tacho-generator goes open circuit, the voltage at the slider of RV1 is then determined by the values of R3, RV1, the setting of the slider thereof, and R4, and simulates a very high tacho-generator output greater than any of the reference voltages and thereby causing the motor control circuit to shut down the motor. The tacho-generator impedance is typically 180 ohms whilst the values of R3, RV1 and R4 may be respectively 18, 10, and 10 kilohms so that in substance the D.C. level at the output side of D3 in normal operation is determined only by tacho-generator output.

Figure 7:
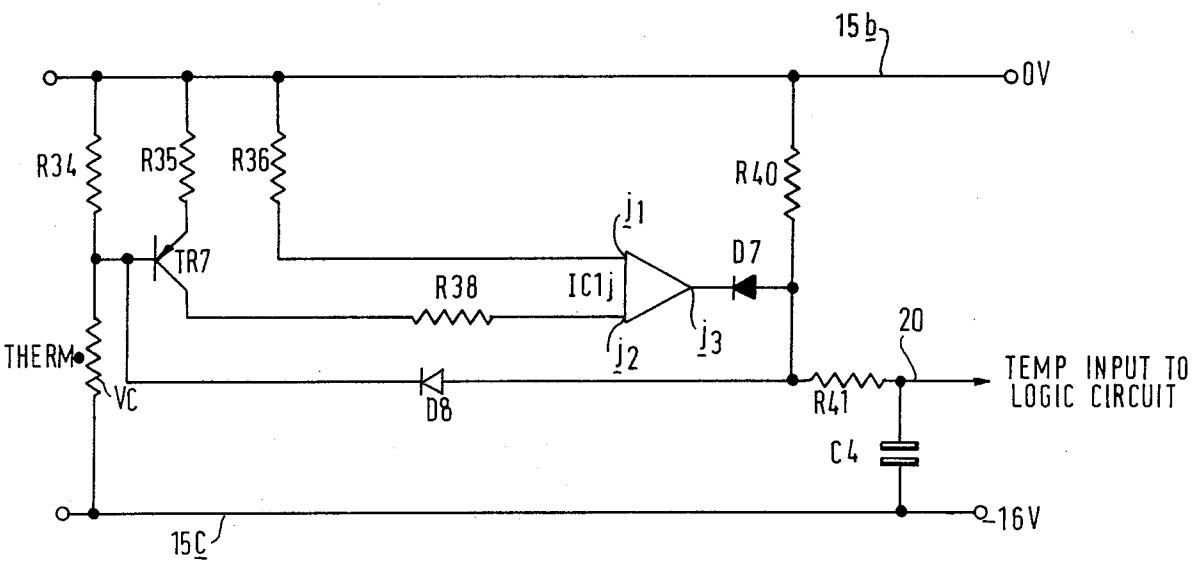
FIG. 7 is a monitoring circuit associated with a thermistor for sensing the water temperature in the machine.

Referring now to FIG. 7, this shows one form of circuit which may be employed for the temperature measuring circuit 24 and monitor circuit 23. These are effectively combined into a single circuit although for clarity of function they are shown separately in the schematic diagram of FIG. 2.

Integrated circuit element IC1*j* which is a comparator, has one input terminal j1, connected via R36 to zero volt conductor 15*b* to establish a reference level. The other input terminal j2 has a voltage level set by a voltage follower circuit R34, R35, TR7. The voltage on the collector of TR7 follows, and is greater than, that of the junction of R34 and thermistor Vc, which latter senses the water temperature of water in the drum.

When the ratio of voltage across thermistor Vc to voltage between the zero volt conductor 15*b* and the −16 volt conductor 15*c*, i.e. 16 volts is greater than R38/R36, i.e. the output at terminal j3 of IC1*j* goes low, and when this ratio is below R38/R36 the output at g3 remains high.

Conductor 20 is connected to the TEMP INPUT terminal 10*h* of logic circuit 10 and the latter incorporates a variable schmitt circuit which is set to operate at a predetermined input signal value to terminate the heating cycle, i.e. generate a "no demand" condition at logic circuit output terminal 10*f*.

The ratio R38/R36 is selected to cause g3 to go low when the thermistor senses a temperature of 95° C. when all component tolerances are such as to tend to increase the voltage level at terminal g2.

In respect of this function the circuit acts as a temperature measuring circuit.

The monitor circuit function is to detect the possible fault of an open circuit thermistor Vc (or a thermistor of which the resistance/temperature characteristic is outside the "high" tolerance value).

If Vc becomes open circuit, the base of TR7 is raised to the zero volt level, terminal j2 rises and simulates a temperature measurement of higher than 95° C., terminating heater demand via the logic circuit 10.

Referring now to FIG. 6, this shows one form of reset driver and latch circuit suitable for employment as the circuit 19, FIG. 2. The essential function is to generate a fault signal to the input (reset) terminal 10*j* of logic circuit 10 in the event of monitor circuits 21 and 22 generating a fault (reset) signal. A further function is to switch off the second switch means Q1*a* via conductors 16, 17, and driver isolator 14*a*, and to latch, i.e. prevent Q1*a* being turned on if the logic circuit has not internally generated an output (reset) signal at terminal 10*a* in response to incidence of a fault (input) signal at terminal 10*j*.

Referring to the circuit of FIG. 6 in detail, the integrated circuit comparator element IC1*h* is connected to the zero volt line 15*b* through resistor R20 to provide a reference at input terminal h1 representing negative input. This holds the output terminal h3 to a low value when there is no input at terminal h2 (representing positive input) from the monitor circuits 21 and 22 via conductors 29, 30 and resistors R23, R24, connected respectively thereto. When a fault (reset) signal is incident on either of conductors 29 and 30 the comparator circuit output terminal h3 goes high and latches in this condition through the feed-back path R25*b*, R25*a*. The high fault signal at h3 is applied through diode D5 via conductor 16 to the CANCEL (reset) input terminal 10*j* of the logic circuit 10. The high fault signal from h3 is also applied through R29 and transistor TR5 to turn off conducting transistor TR6 and hence turn off triac Q1*a* as already mentioned.

The main switch S1*a* is preferably operatively connected with a door lock mechanism which serves to hold the door 5 of the machine in its closed position when the switch S1*a* is closed and the door lock is in its operated position.

This may be done by mechanical connection between the door lock mechanism and the switch contacts S1*a*, e.g. by using the operating means 12*a* to operate both S1*a* and either move the door lock to its operated position or to establish maintainence of the door lock in its operated position when it has been operated in some other manner e.g. by closing the door manually.

If the logic circuit is functioning normally, the door lock demand (which is also demand for closure of switch S1*a*) and which is provided by an output (set) signal at terminal 10*a* is turned off due to cancellation of the programme on incidence of the fault (reset) signal at input (reset) terminal 10*j* via conductor 16. Transistor TR4 which was held turned on by door lock demand signal applied to its base, then turns off, and allows a further current input through R26 and R22 to be applied to input terminal h1.

The delay means included as mentioned in the operating means 12*a* then times out, the door lock is opened or released for opening, S1*a* opens, and a mains detector circuit R17, R18, D3, and D4 on the dead side of S1*a* undergoes a change of output at the junction D3, D4, from a positive voltage value to approximately zero volts and turns transistor TR3 on.

The combined current input to the terminal h1 (representing negative input) now exceeds the current input terminal h2 (representing positive input), and output terminal h3 reverts to its low level corresponding to "normal" conditions.

The current input through TR3, R20 and R21 to H1 always overrides current input through R23 and R24 to h2 when the output terminal $h_3$ of comparator IC1*h* is low (and IC1*h* has not latched via R25*a*, 25*b*) and if no programme is selected the additional input to h1 through R26 and R22 guarantees maintenance of a low output at the output terminal h3. In the event of a failure of the logic circuit 10 to turn off the output (set) signal at terminal 10*a* i.e. demand for operating means 12*a* is still generated and appears at internally terminal 10*a* in response to a fault (reset) signal on line 16, transistor TR4 continues to conduct, inhibiting current flow through R22 to terminal h1. When the operating means for Sl*a* and the door lock times out, TR3 turns on as above described. However, the absence of current via R22 prevents current to h1 predominating over that applied at h2 and hence prevents comparator IC1*h* from being reset. The circuit including TR5 and TR6 acting as a driver for the operating means 12*a* for the switch S1*a* and door lock remains inhibited (i.e. TR5 on and TR6 off) resulting in a permanently safe state being maintained so long as logic circuit fails to generate an output (reset) signal at 10*a*. This inhibited condition can be removed only by switching off the main 240 volt supply from conductor 15*a*, 15*b*.

The following table summarises the above described operations.

| Truth table | Condition | Heater Output | Motor Output | Door Lock Mains | Door Lock De-mand | Comp. IClh Output |
|---|---|---|---|---|---|---|
| Waiting for door lock | No programme selected | ON | ON | OFF | OFF | LOW |
| | Programme selected but door lock off | ON | ON | OFF | ON | LOW |
| | Programme selected but no fault | OFF | OFF | ON | ON | LOW |
| | Heater fault | ON | OFF | ON | ON | HIGH (fault) |
| | Motor fault | OFF | ON | ON | ON | HIGH (fault) |
| After fault | Door lock de-energised but logic circuit not reset. | ON | ON | OFF | ON | HIGH (fault) |

I claim:

1. A control circuit for controlling the supply of current from a source to an apparatus which includes a plurality of functional means required to be brought into operation in a sequence in accordance with at least one predetermined programme, such circuit comprising:

a. a first switch means controlling the supply of current to at least some of said functional means, b. a main control means for furnishing signals to control operation of said functional means in accordance with said programme and to set the first switch means in a closed or open position in accordance with demand requirements of said programme applicable to the apparatus, c. at least one monitoring means each associated with a respective one of the functional means for generating a fault signal in response to occurrence of a fault condition, d. means connecting the monitoring means with the main control means to cause the latter to set the first switch means in an open condition in response to generation of said fault signal, e. a second switch means for controlling current to at least one of said functional means brought into operation in said programme, and f. a back-up circuit means connecting the second switch means and the monitoring means, the second switch means being responsive to generation of said fault signal to cut off current to said functional means to which current is controlled by said second switch means irrespective of response of the main control means to said fault signal.

2. A control circuit according to claim 1 wherein the back-up circuit means includes latch means for maintaining the first switch means in its open condition when it has been opened through generation of a fault signal and operation of the back-up circuit means.

3. A control circuit according to claim 2 wherein a. said latch means comprises a comparator means having first and second input terminals, b. said first input terminal is connected to a sub-circuit providing an input changing in value in accordance with the incidence or not of a fault signal, c. said second terminal is connected to a sub-circuit providing an input changing in value in accordance with a combination of an output signal from said main control means and the opening and closing of the first switch means, d. the comparator means has an output presenting one or other of different values which respectively maintain the second switch means closed, or cause it to open, the latter value being maintained permanently upon incidence of a fault signal in the absence of an output (reset) signal from the main control means.

4. A control circuit according to claim 1 wherein
a. said first switch means comprises a main switch contact movable relatively between opened and closed position,
b. one of the functional means comprises electrically energised operating means for the main switch contact,
c. said electrically energised operating means is controlled by the second switch means which latter is responsive to either the generation of an output (reset) signal from the main control means, or the operation of the back-up circuit means in response to generation of a fault signal.

5. A control circuit according to claim 4 wherein the main control means includes an electronic programming means for determining the sequence, duration, mode of operation, of said functional means, and is settable to generate said output (reset) signal in response to generation of a fault signal by said monitoring means.

6. A control circuit according to claim 5 wherein
a. said second switch means comprises a semi-conductor switch,
b. conductor means are provided connecting said semi-conductor switch in a circuit controlling the supply of current to said electrically energised operating means for the main switch contacts,
c. said semi-conductor switch is itself responsive
i. to said output (reset) signal from the programming means and
ii. through the back-up circuit means to said fault signal
in a manner such that either of these two last said signals is operative to cause said semi-conductor switch to interrupt current supply to the operating means for the main switch contacts.

7. A control circuit according to claim 1 wherein the monitoring means comprises one or more monitoring circuits each of which comprises
a. a comparator means having at least two input terminals and an output terminal,
b. one of the two input terminals being connected to a sub-circuit providing an input of reference level,
c. at least one other of the input terminals being connected to a sub-circuit containing a sensing means and providing an input which varies according to the parameter being sensed in the associated functional means,
d. the output terminal providing an output the value of which changes from a normal value to a fault value according to whether the functional means associated with the monitoring circuit is operating normally or has become abnormal.

8. In a machine for subjecting articles to treatment involving a liquid, such machine comprising a body, including a chamber in which the articles can be placed for treatment, a plurality of functional means for performing respective functions during a treatment programme and including means for effecting transfer of the liquid to and from the chamber so that it is brought into contact with, or removed from, the articles, and means for subjecting either the liquid or the articles to motion while both are in the chamber, said functional means being each electrically controlled or operated, a control circuit for bringing the functional means into and out of operation in accordance with one or more selected programmes to effect the particular treatment required, the improvement wherein said control circuit comprises
a. a first switch means controlling the supply of current to at least some of said functional means,
b. a main control means for furnishing signals to control operation of said functional means in accordance with said programme and to set the first switch means in a closed or open position in accordance with demand requirements of said programme,
c. at least on monitoring means each associated with the respective one of the functional means for generating a fault signal in response to occurrence to a fault condition,
d. means connecting the monitoring means with the main control means to cause the latter to set the first switch means in an open condition in response to generation of said fault signal,
e. a second switch means for controlling current to at least one of said functional means brought into operation in said programme, and
f. a back-up circuit means connecting the second switch means and the monitoring means, the second switch means being responsive to generation of said fault signal to cut off current to said functional means to which current is controlled by said second switch means irrespective of response to the main control means to said fault signal.

* * * * *